US008449321B2

(12) United States Patent
Raybold et al.

(10) Patent No.: US 8,449,321 B2
(45) Date of Patent: May 28, 2013

(54) POWER CONNECTORS AND ELECTRICAL CONNECTOR ASSEMBLIES AND SYSTEMS HAVING THE SAME

(75) Inventors: Christopher Ryan Raybold, Elizabethtown, PA (US); Michael Timothy Sykes, Harrisburg, PA (US); Jason M'Cheyne Reisinger, Carlisle, PA (US); Michael Allen Blanchfield, Camp Hill, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 89 days.

(21) Appl. No.: 13/166,492

(22) Filed: Jun. 22, 2011

(65) Prior Publication Data

US 2012/0329294 A1 Dec. 27, 2012

(51) Int. Cl.
*H01R 13/60* (2006.01)

(52) U.S. Cl.
USPC ..... 439/540.1

(58) Field of Classification Search
USPC ..... 439/55, 540.1
See application file for complete search history.

(56) References Cited

U.S. PATENT DOCUMENTS 3,727,168 A * 4/1973 Henschen et al. ..... 439/498
3,796,986 A * 3/1974 Tamburro ..... 439/329
4,845,592 A * 7/1989 Himes et al. ..... 361/775
5,080,609 A * 1/1992 Fabian et al. ..... 439/541.5
5,244,410 A * 9/1993 Demus et al. ..... 439/497
6,886,914 B2 * 5/2005 Hiramoto et al. ..... 347/50
8,040,688 B2 * 10/2011 Tatsukami et al. ..... 361/807
2011/0056924 A1 * 3/2011 Townsend ..... 219/213

OTHER PUBLICATIONS

Connector, Power, 4 Position, 6 AWG Contact Special Design; (C) Tyco Electronics, 2006.

* cited by examiner

*Primary Examiner* — Neil Abrams
*Assistant Examiner* — Travis Chambers

(57) ABSTRACT

A power connector including a connector housing having an interior cavity and a mating face. The connector housing is configured to be mounted to a circuit board. The power connector also includes a contact assembly that has anode and cathode contacts that are configured to electrically engage power contacts of a mating connector. The contact assembly also includes anode and cathode terminals that are disposed in the interior cavity. The anode and cathode terminals are electrically coupled to the anode and cathode contacts, respectively, and are configured to be electrically coupled to the circuit board. The power connector also includes a power cable that has substantially flat anode and cathode conductive layers that are surrounded by an insulative jacket. The anode and cathode conductive layers are electrically coupled to the anode and cathode contacts, respectively, and are electrically parallel to the anode and cathode terminals, respectively.

20 Claims, 5 Drawing Sheets

POWER CONNECTORS AND ELECTRICAL CONNECTOR ASSEMBLIES AND SYSTEMS HAVING THE SAME

BACKGROUND OF THE INVENTION

The subject matter herein relates generally to electrical connector assemblies for transmitting power to an electrical system.

In some known connector assemblies, a pair of power connectors are mounted to a circuit board and positioned near each other with a space between the power connectors. The power connectors may face a common direction such that the power connectors are configured to receive mating connectors from the same insertion direction. Each of the power connectors includes an anode contact and a cathode contact. The power connectors can be electrically interconnected to each other and to the circuit board. For example, first and second power connectors can be electrically interconnected through wires such that power from the first power connector can be delivered through the second power connector and vice versa. During operation, either of the first or second power connectors can be energized or both of the first and second power connectors can be energized. The first and second power connectors are mechanically coupled to one another with a bridge element that extends across a space located between the two power connectors.

However, the above connector assembly can have limited capabilities. For example, the bridge element extending between the two power connectors can limit the size of other connectors or components that are desired to be positioned between the two power connectors. Furthermore, the wires are hand soldered to the circuit board and power connectors, which can lead to higher costs of manufacturing. In addition, the above connector assemblies use braided cable wires, which can transmit only limited amounts of current.

Accordingly, there is a need for electrical connector assemblies having multiple interconnected power connectors that permit the placement of components between the power connectors, that are capable of delivering higher levels of current than the above connector assembly, and/or that are capable of electrically connecting the conductors to the circuit board or connectors without soldering by hand.

BRIEF DESCRIPTION OF THE INVENTION

In one embodiment, a power connector is provided that includes a connector housing having an interior cavity and a mating face. The connector housing is configured to be mounted to a circuit board. The power connector also includes a contact assembly that has anode and cathode contacts that are configured to electrically engage power contacts of a mating connector. The contact assembly also includes anode and cathode terminals that are disposed in the interior cavity. The anode and cathode terminals are electrically coupled to the anode and cathode contacts, respectively, and are configured to be electrically coupled to the circuit board. The power connector also includes a power cable that has substantially flat anode and cathode conductive layers that are surrounded by an insulative jacket. The anode and cathode conductive layers are electrically coupled to the anode and cathode contacts, respectively, and are electrically parallel to the anode and cathode terminals, respectively.

In another embodiment, an electrical connector assembly is provided that includes first and second power connectors that are configured to be mounted to a circuit board and are spaced apart by a separation distance on the circuit board.

Each of the first and second power connectors includes a connector housing and a contact assembly that is held by the connector housing. The contact assembly of the first power connector is electrically coupled to the circuit board at a first interconnection. The contact assembly of the second power connector is electrically coupled to the circuit board at a second interconnection. The connector assembly also includes a power cable that is configured to extend across the separation distance and electrically couple the contact assemblies of the first and second power connectors. The power cable includes a substantially flat conductive layer and an insulative jacket that surrounds the conductive layer. The first power connector is electrically coupled to the second interconnection through the conductive layer, and the second power connector is electrically coupled to the first interconnection through the conductive layer.

In another embodiment, an electrical connector assembly is provided that includes a circuit board and a communication connector that is coupled to the circuit board. The communication connector has opposite first and second sides and a mating face that extends between the first and second sides. The connector assembly also includes a first power connector that is coupled to the circuit board proximate to the first side of the communication connector, and a second power connector that is coupled to the circuit board proximate to the second side of the communication connector. The connector assembly also includes a power cable that extends between and electrically couples the first and second power connectors. The power cable includes a substantially flat conductive layer that is surrounded by an insulative jacket. The power cable is configured to convey electrical power bi-directionally between the first and second power connectors.

DETAILED DESCRIPTION OF THE INVENTION

Figure 1:
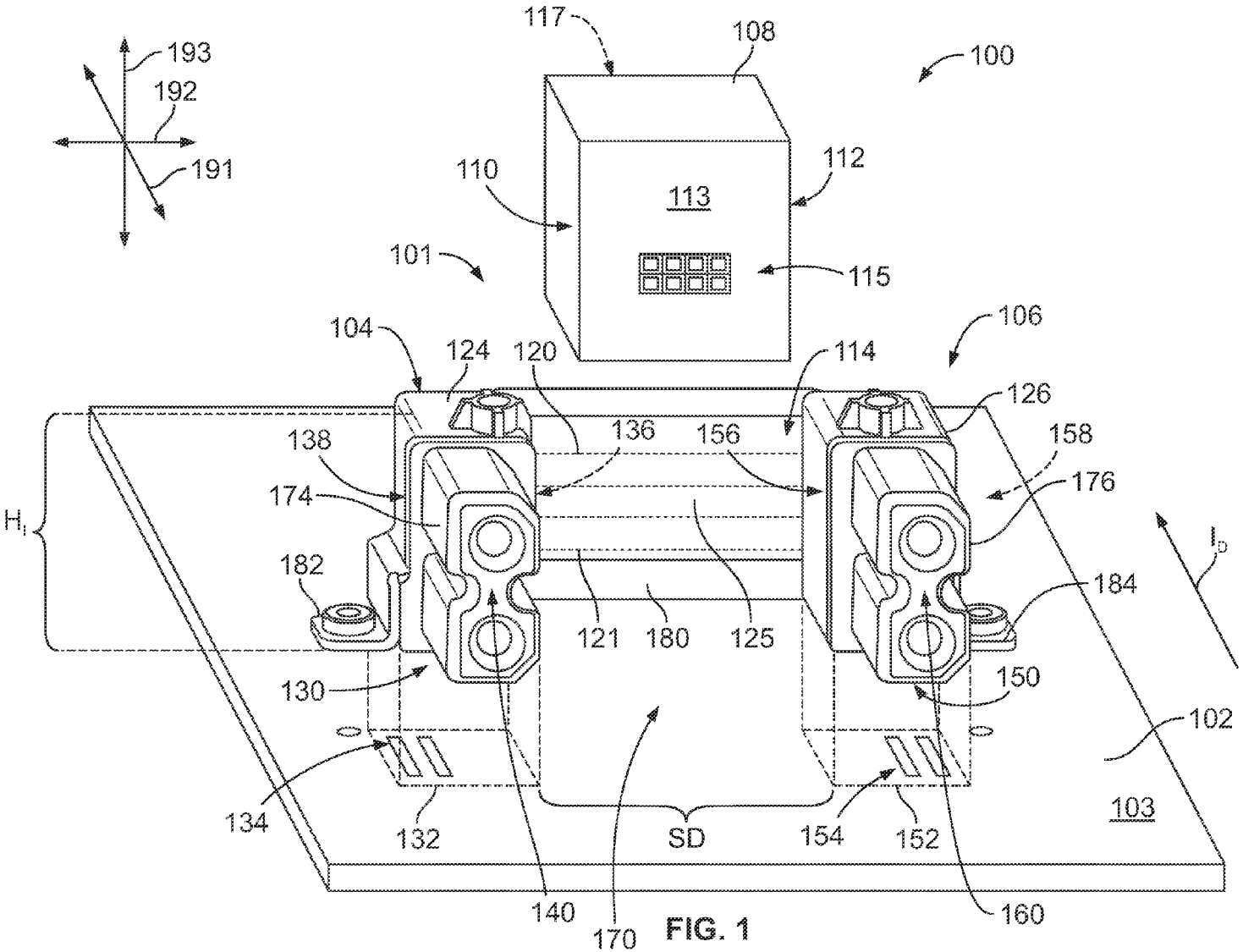
FIG. 1 is a partially exploded view of an electrical system including an electrical connector assembly formed in accordance with one embodiment.

FIG. 1 illustrates a partially exploded view of an electrical system 100 formed in accordance with one embodiment. The electrical system 100 is oriented with respect to mutually perpendicular axes 191-193 including a mating axis 191, a lateral axis 192, and an elevation axis 193. The electrical system 100 includes an electrical connector assembly 101 configured to be mounted to a printed circuit board 102. As shown, the connector assembly 101 includes first and second power connectors 104, 106 that are configured to be mounted to the circuit board 102.

In the exemplary embodiment, the connector assembly 101 may include a communication connector 108 that is also configured to be mounted to the circuit board 102. The communication connector 108 has first and second sides 110, 112 that face in opposite directions along the lateral axis 192. The communication connector 108 also has mating and rear faces 113, 117 that face in opposite directions along the mating axis 191 and extend between the first and second sides 110, 112. In the illustrated embodiment, the mating face 113 includes a mating array 115 of electrical contacts. The mating array 115 is configured to engage electrical contacts of another communication connector (not shown) when the other communication connector is moved in an insertion direction $I_D$ along the mating axis 191 and mated with the communication connector 108.

The first and second power connectors 104, 106 may be coupled to the circuit board 102 proximate to the first and second sides 110, 112, respectively, of the communication connector 108. In some embodiments, the first and second power connectors 104, 106 are adjacent to the first and second sides, 110, 112, respectively, such that no other component or element coupled to the circuit board 102 is located between the respective power connector and side of the communication connector 108. In particular embodiments, the first and second power connectors 104, 106 may be immediately adjacent to the first and second sides, 110, 112, respectively, as the first and second power connectors 104, 106 would be in FIG. 1 when the communication connector 108 is mounted to the circuit board 102.

As shown, the connector assembly 101 includes a power cable 114 that extends between and electrically couples the first and second power connectors 104, 106. The power cable 114 includes a substantially flat conductive layer surrounded by an insulative jacket. For example, in particular embodiments, the power cable 114 includes anode and cathode conductive layers 121, 120 (indicated by phantom lines) that are surrounded by an insulative jacket 125. The anode conductive layer 121 may also be characterized as the power (or "hot") conductive layer that delivers electrical power to the electrical system 100. The cathode conductive layer 120 may also be characterized as the return conductive layer.

The power connector 104 is configured to deliver power directly to the circuit board 102 at an electrical interconnection that is proximate to the power connector 104 and/or deliver power to the power cable 114, which then delivers the power to the power connector 106. For example, current may be split along separate paths in which a first path extends from the power connector 104 directly to the circuit board 102 and a second path extends from the power connector 104 to the power connector 106 through the power cable 114. Likewise, the power connector 106 is configured to deliver power directly to the circuit board 102 at an electrical interconnection that is proximate to the power connector 106 and/or deliver power to the power cable 114, which then delivers the power to the power connector 104. Current may be split along separate paths in which a first path extends from the power connector 106 directly to the circuit board 102 and a second path extends from the power connector 106 to the power connector 104 through the power cable 114.

In a similar manner, each of the power connectors 104, 106 may receive current along a return path that extends directly through the circuit board 102 and/or current along a return path through the power cable 114. As such, the power cable 114 is configured to convey electrical power bi-directionally between the first and second power connectors 104, 106. When the communication connector 108 is mounted onto the circuit board 102, the power cable 114 may extend adjacent to the rear face 117 of the communication connector 108. In particular embodiments, the power cable 114 is a wave crimp cable similar to those developed by Tyco Electronics.

The power connectors 104, 106 include connector housings 124, 126 that are manufactured from a dielectric material. The connector housings 124, 126 have respective mounting interfaces 130, 150 that are configured to engage the circuit board 102 when the power connectors 104, 106 are mounted thereon. Each of the connector housings 124, 126 has a footprint (e.g., an outer perimeter of the mounting interface 130, 150). The footprints may define respective mounting areas 132, 152 along a surface 103 of the circuit board 102 (indicated by phantom lines on the surface 103) when the power connectors 104, 106 are mounted on the surface 103. As shown, the circuit board 102 may include electrical interconnections 134, 154 within the mounting areas 132, 152, respectively.

In particular embodiments, the power connectors 104, 106 are electrically coupled to the circuit board 102 within the mounting areas 132, 152 through the respective interconnections 134, 154. The interconnections 134, 154 may be plated thru-holes or other types of electrical interconnections (e.g., contact pads, contact beams, solder balls, insulation displacement contacts (IDCs) and the like). In such embodiments where the interconnections 134, 154 occur proximate to or within the mounting areas 132, 152, the connector assemblies 101 may require less space than known connector assemblies that include wires extending to remote interconnections exterior to the connector housings.

Also shown in FIG. 1, the connector housings 124, 126 have respective inner sidewalls 136, 156 that face the communication connector 108 and respective outer sidewalls 138, 158 that face away from the communication connector 108. The connector housings 124, 126 include respective mating faces 140, 160 that are configured to engage power contacts (not shown) from mating connectors (not shown). The connector housings 124, 126 include mating portions 174, 176 that include the mating faces 140, 160, respectively. The mating portions 174, 176 are sized and shaped to be received by the mating connectors.

The power connectors 104, 106 are separated from each other by a component-receiving space 170 where the communication connector 108 and/or other parts and components of the electrical system 100 may be located. In other embodiments, there may not be any parts or components located in the component-receiving space 170 (i.e., the component-receiving space 170 can be vacant when the connector assembly 101 is in operation). The power connectors 104, 106 are separated by a separation distance SD. The separation distance SD is measured in a direction along the lateral axis 192 and extends between the opposing inner sidewalls 136, 156. In the illustrated embodiment, the separation distance SD is sized to accommodate only the communication connector 108. In other embodiments, the separation distance SD may be configured to accommodate a plurality of communication connectors.

In the exemplary embodiment, the component-receiving space 170 is configured to extend beyond a height $H_1$ of the power connectors 104, 106. The component-receiving space 170 may be open above the connector assembly 101 thereby permitting communication connectors 108 that have a greater height than the height $H_1$. More specifically, the power connectors 104, 106 may not include structural components other than the power cable 114 that extend across the component-receiving space 170 and restrict the size and/or placement of the communication connector 108.

Also shown in FIG. 1, the connector assembly 101 includes a rigid support structure 180 that extends across the separation distance SD. The support structure 180 may partially define the component-receiving space 170. The support structure 180 mechanically couples to the first and second power connectors 104, 106. The power cable 114 extends alongside the support structure 180. The support structure 180 is configured to be secured to the circuit board 102 to facilitate supporting the power connectors 104, 106 when the mating connectors engage the power connectors 104, 106. For example, the support structure 180 may include a pair of mounting members 182, 184 (e.g., brackets) that are configured to be mounted to the circuit board 102. The mounting members 182, 184 may be fastened using a threaded fastener, bolt, rivet, plug, and the like. In some embodiments, the support structure 180 is electrically conductive and provides electromagnetic interference (EMI) shielding. The support structure 180 may also be thermally conductive and define a heat sink for dissipating heat from the power connectors 104, 106 and/or from the communication connector 108.

Figure 2:
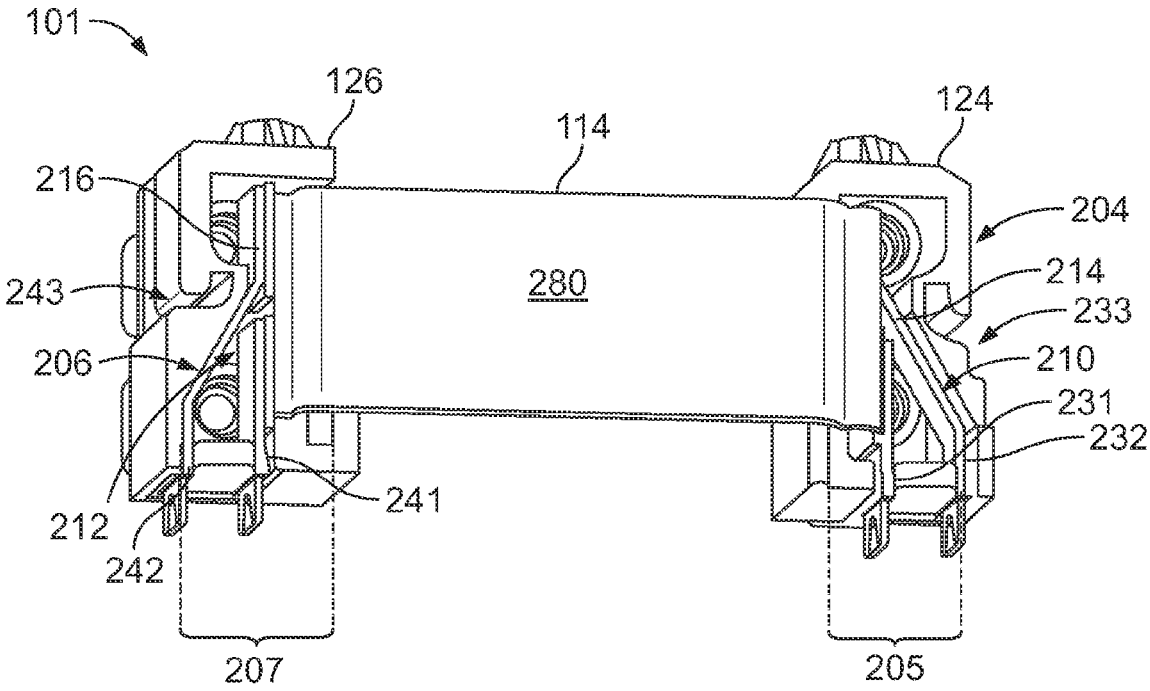
FIG. 2 is a rear perspective view of the connector assembly of FIG. 1 having a support structure removed.

FIG. 2 is a rear perspective view of the connector assembly 101 having the support structure 180 (FIG. 1) removed. The connector housings 124, 126 include rear faces 204, 206, respectively, having openings 205, 207, respectively. The openings 205, 207 provide access to respective interior cavities 210, 212 of the respective connector housings 124, 126. The connector assembly 101 includes contact assemblies 214, 216 that are disposed within the interior cavities 210, 212. In the illustrated embodiment, the power cable 114 is configured to extend from an exterior of the connector housing 124 and through the opening 205 into the interior cavity 210. The power cable 114 may be electrically and mechanically coupled to the contact assembly 214 within the interior cavity 210. Likewise, the power cable 114 is configured to extend from an exterior of the connector housing 126 and through the opening 207 into the interior cavity 212. The power cable 114 may be electrically and mechanically coupled to the contact assembly 216 within the interior cavity 212.

The connector housing 124 includes terminal-receiving slots 231, 232 and a mounting slot 233. The slots 231-233 extend from the rear face 204 toward the mating face 140 (FIG. 1) of the connector housing 124. The connector housing 126 includes terminal-receiving slots 241, 242 and a mounting slot 243. The slots 241-243 extend from the rear face 206 toward the mating face 160 (FIG. 1) of the connector housing 126. Also shown in FIG. 2, the power cable 114 may have a rearward-facing surface 280 that may face in the insertion direction $I_D$ (FIG. 1).

Figure 3:
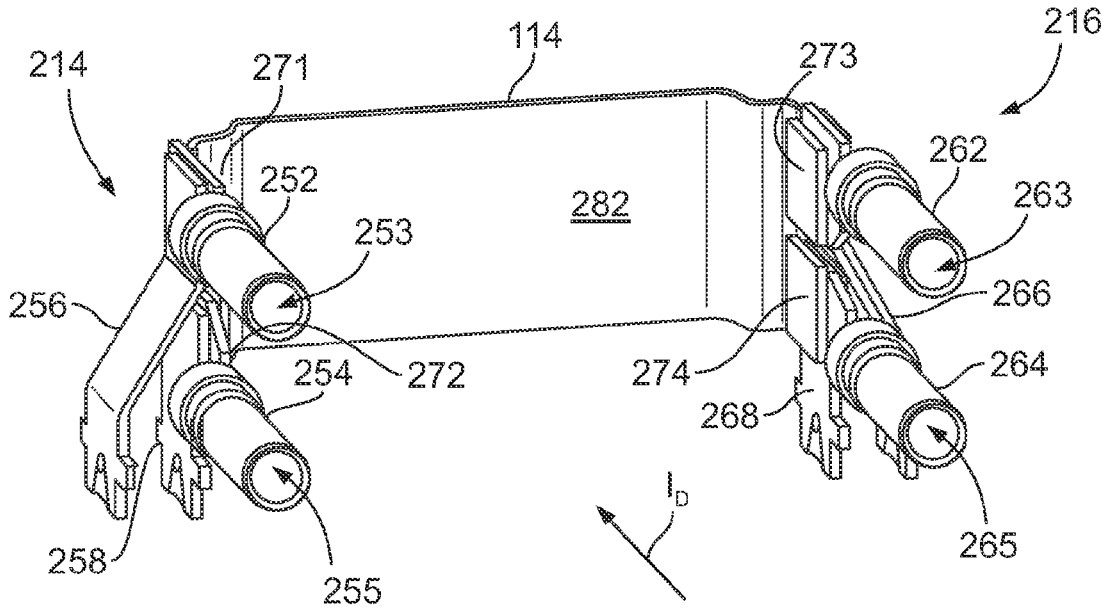
FIG. 3 is a front perspective view of a pair of contact assemblies and a power cable that may be used with the connector assembly of FIG. 1.

FIG. 3 is a front perspective view the contact assemblies 214, 216 and the power cable 114 extending therebetween. For illustrative purposes, the connector housings 124, 126 (FIG. 1) have been removed from the connector assembly 101 (FIG. 1). Thus, as shown in FIG. 3, the contact assemblies 214, 216 and the power cable 114 are positioned and oriented in the same manner that the contact assemblies 214, 216 and the power cable 114 are to be positioned and oriented in the fully constructed connector assembly 101.

The contact assembly 214 includes anode and cathode contacts 254, 252. Anode and cathode contacts may also be generally referred to as mating contacts. Similar to the anode and cathode conductive layers 121, 120 (FIG. 1), the anode contacts may be characterized as the power or "hot" contacts and the cathode contacts may be characterized as the return contacts. The anode and cathode contacts 254, 252 are configured to electrically engage respective power contacts (not shown) of the mating connector (not shown) proximate to the mating face 140 (FIG. 1). In the exemplary embodiment, the anode and cathode contacts 254, 252 are socket contacts (e.g., barrel contacts) configured to receive pin contacts when the pin contacts are moved in the insertion direction $I_D$. For example, the anode and cathode contacts 254, 252 may include respective contact-receiving passages 255, 253 that are sized and shaped to receive the pin contacts.

The contact assembly 214 also includes anode and cathode terminals 258, 256 that are configured to be disposed in the interior cavity 210 (FIG. 2). Anode and cathode terminals may also be generally referred to as component terminals. The anode and cathode terminals 258, 256 are electrically coupled to the anode and cathode contacts 254, 252, respectively, and configured to be electrically coupled to the circuit board 102 (FIG. 1).

In a similar manner, the contact assembly 216 includes anode and cathode contacts 264, 262. The anode and cathode contacts 264, 262 are configured to electrically engage respective power contacts proximate to the mating face 160. In the exemplary embodiment, the anode and cathode contacts 264, 262 are socket contacts configured to receive corresponding pin contacts. The anode and cathode contacts 264, 262 may include contact-receiving passages 265, 263 that are sized and shaped to receive the pin contacts. In addition, the contact assembly 216 includes anode and cathode terminals 268, 266 that are configured to be disposed in the interior cavity 212. The anode and cathode terminals 268, 266 are electrically coupled to the anode and cathode contacts 264, 262, respectively, and configured to be electrically coupled to the circuit board 102.

The power cable 114 includes conductor or layer ends 271-272 that are configured to electrically and mechanically couple to the contact assembly 214 and also conductor or layer ends 273-274 that are configured to electrically and mechanically couple to the contact assembly 216. More specifically, the anode conductive layer 121 (FIG. 1) may extend between the layer ends 272 and 274 and the cathode conductive layer 120 (FIG. 1) may extend between the layer ends 271 and 273. In the illustrated embodiment, the layer end 271 extends alongside and directly couples to the cathode contact 252. Similarly, the layer end 273 extends alongside and directly couples to the cathode contact 262. However, in other embodiments, the layer ends 271 and 273 may directly couple to the cathode terminals 256, 266. Likewise, the layer ends 272, 274 extend alongside and directly couple to the anode contacts 254, 264. In other embodiments, the layer ends 272 and 274 may directly couple to the anode terminals 258, 268. Also shown in FIG. 3, the power cable 114 may have a forward-facing surface 282 that faces in a direction that is opposite of the insertion direction $I_D$.

The cathode contacts 252, 262 and/or the anode contacts 254, 264 may be manufactured using any one of various methods. In the exemplary embodiment, the anode and cathode contacts are stamped and formed from conductive sheet material. However, the cathode contacts 252, 262 and/or the anode contacts 254, 264 may also be machined, molded or die-cast, or formed by another process.

Figure 4:
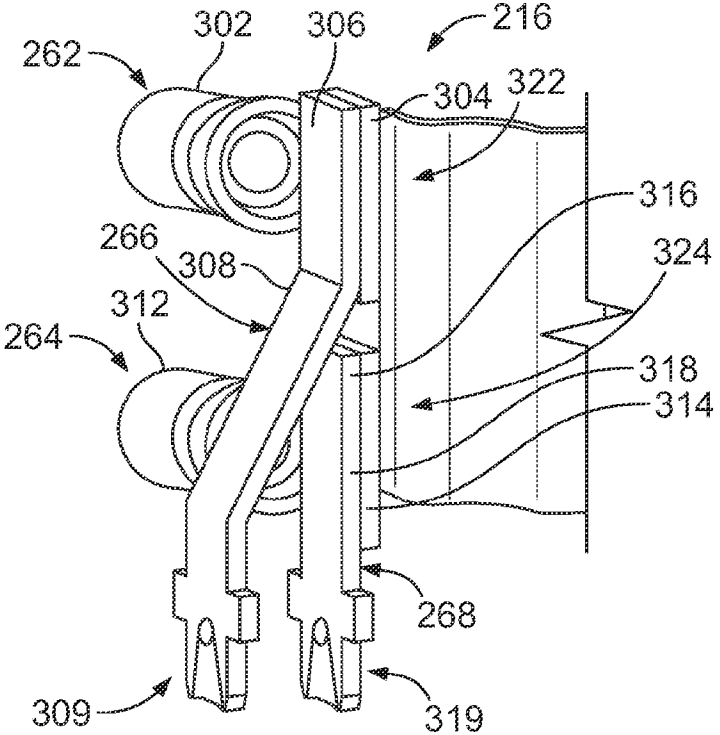
FIG. 4 is a rear perspective view of one of the contact assemblies of FIG. 3.

FIG. 4 is a rear perspective view of the contact assembly 216. Although the following is with reference to the contact assembly 216 and its various features, the description may be similarly applicable to the contact assembly 214 (FIG. 2) and its various features. In the illustrated embodiment, the cathode and anode contacts 262 and 264 are identical in size and shape. For example, the cathode contact 262 has a contact-engaging portion 302 and a contact tab 304 that is coupled to the contact-engaging portion 302, and the anode contact 264 has a contact-engaging portion 312 and a contact tab 314 that is coupled to the contact-engaging portion 312. In particular embodiments, the contact tab 304 may directly extend from the contact-engaging portion 302, and the contact tab 314 may directly extend from the contact-engaging portion 312. However, in other embodiments, the contact tabs and the contact-engaging portions may be separate elements that are coupled together (e.g., welded or soldered). The anode and cathode contacts 264, 262 may also be differently sized and/or shaped.

The cathode and anode terminals 266, 268 have respective terminal tabs 306, 316 and respective body portions 308, 318. The terminal tabs 306, 316 are configured to be directly coupled to the contact tabs 304, 314, respectively. Furthermore, the cathode and anode terminals 266, 268 also include circuit-engagement portions 309, 319 that are configured to mechanically and electrically engage the circuit board 102 (FIG. 1). As shown in FIG. 4, each of the contact tabs, terminal tabs, body portions, and circuit-engagement portions are substantially planar sections of stamped and formed sheet material. However, in other embodiments, one or more of the contact tabs, terminal tabs, body portions, or circuit-engagement portions may have contoured shapes and/or may be fabricated in other manners (e.g., die-cast, machined).

As shown in FIG. 4, the contact assembly 216 includes electrical joints 322, 324 where at least two of the associated contact tabs, terminal tabs, and layer ends are mechanically and electrically coupled to one another. In particular embodiments, each of the associated contact tabs, terminal tabs, and layer ends are mechanically and electrically coupled to one another at an electrical joint. For instance, the contact assembly 216 may include the layer end 273 (FIG. 3), the contact tab 304, and the terminal tab 306 being mechanically and electrically coupled to one another at the electrical joint 322. More specifically, the layer end 273 may interface with the contact tab 304 that, in turn, interfaces with the terminal tab 306. In the illustrated embodiment, the terminal tab 306, the contact tab 304, and the layer end 273 are side-by-side (e.g., sandwiched) in a direction along the lateral axis 192 (FIG. 1). In a similar manner, the contact assembly 216 may include the layer end 274 (FIG. 3), the contact tab 314, and the terminal tab 316 being mechanically and electrically coupled to one another at the electrical joint 324.

In particular embodiments, the contact assembly 216 is configured to permit movement of the cathode and anode contacts 262, 264 relative to the connector housing 126 (FIG. 1) such that the cathode and anode contacts 262, 264 float relative to the connector housing 126. For example, the contact tabs 304, 314 may be reduced in thickness to permit the contact-engaging portions 302, 312 to flex in directions along the lateral axis 192. In other embodiments, the contact tabs 304, 314 may be sized and shaped to permit flexion in directions along the elevation axis 193 (FIG. 1). Accordingly, when the power contacts (not shown) of the mating connector (not shown) engage the cathode and anode contacts 262, 264, the contact-engaging portions 302, 312 may float relative to the connector housing 126 to facilitate engaging the cathode and anode contacts 262, 264 with the corresponding power contacts.

In the illustrated embodiment, the cathode and anode contacts 262 and 264 are stacked relative to each other. For instance, the contact-engaging portions 302, 312 may be aligned with each other relative to the elevation axis 193, and the contact tabs 304, 314 may be aligned with each other relative to the elevation axis 193. Likewise, the electrical joints 322 and 324 may be stacked relative to the elevation axis 193. To engage the circuit board 102, the body portion 308 of the cathode terminal 266 may approach the circuit board 102 at a non-orthogonal angle. The circuit-engagement portions 309, 319 may comprise T-shaped structures that are configured to be inserted into the circuit board 102 to mechanically and electrically engage the interconnections 154 (FIG. 1). The circuit-engagement portions 309, 319 may be wave-soldered to the interconnections 154. By way of example only, the circuit-engagement portions 309, 319 may be similar to FASTON tabs developed by Tyco Electronics.

After the contact assembly 216 is constructed as shown in FIG. 4 and the contact assembly 214 is also assembled, the power cable 114 (FIG. 1) may be coupled to both contact assemblies 214, 216. The contact assemblies 214, 216 may then be inserted into the interior cavities 210, 212 (FIG. 2) of the connector housings 124, 126 (FIG. 1). More specifically, the contact assemblies 214, 216 may be inserted through the openings 205, 207 (FIG. 2) of the rear faces 204, 206 (FIG. 2), respectively. With respect to the contact assembly 216, the cathode and anode terminals 266 and 268 are advanced through the terminal-receiving slots 242, 241 (FIG. 2), respectively. Before or after disposing the contact assemblies 214, 216 into the interior cavities 210, 212 of the connector housings 124, 126, the circuit-engagement portions 309, 319 may be inserted into the interconnections 154.

During operation, electrical power transmitted through the anode contact 264 may be transmitted along one or more current paths. For example, electrical power from the anode contact 264 may be transmitted along a first path through the anode terminal 268 into the circuit board 102. Alternatively, the electrical power from the anode contact 264 may be transmitted along a second path through the layer end 274 and the anode conductive layer 121 (FIG. 1) to a remote interconnection, such as the power connector 104 (FIG. 1). Although the above only describes two current paths, there may be additional current paths in other embodiments.

Furthermore, at various times, the electrical power may be split between the first path and the second path. The first and second paths may be electrically parallel. Accordingly, electrical power may be transmitted through both of the first and second power connectors 104, 106 (FIG. 1) even if only one of the anode contacts 254, 264 (FIG. 3) is receiving electrical power. More specifically, the power connector 104 may be electrically coupled to the interconnections 154 through the power cable 114, and the power connector 106 may be electrically coupled to the interconnections 134 (FIG. 1) through the power cable 114.

Figure 5:
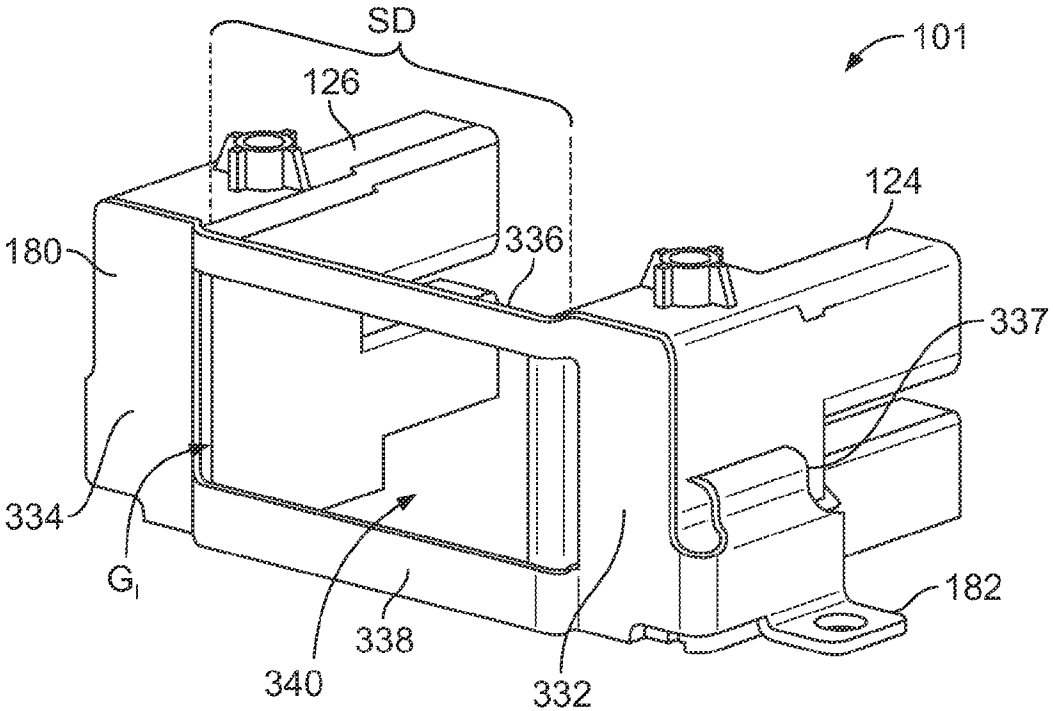
FIG. 5 is a rear perspective view of the connector assembly of FIG. 1 illustrating the support structure in greater detail.
Figure 6:
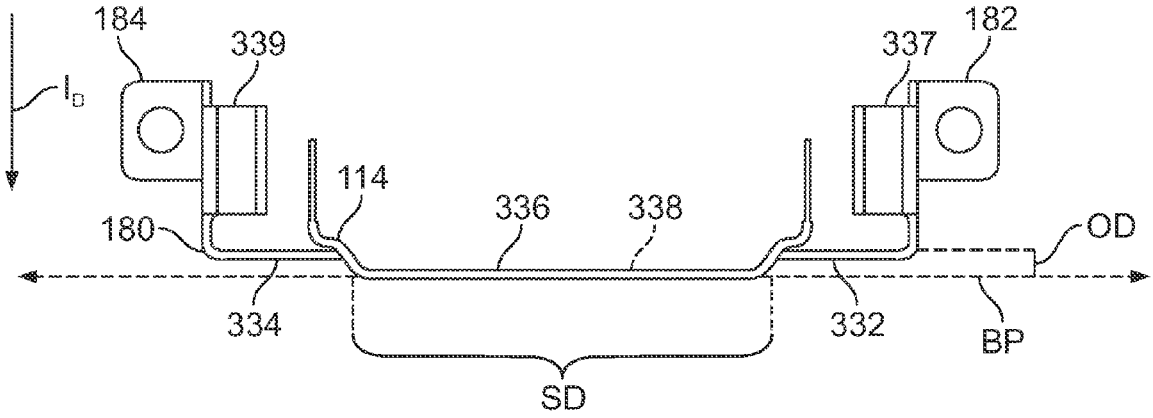
FIG. 6 is a plan view of the support structure and the power cable that extends alongside the support structure.

FIGS. 5 and 6 illustrate the support structure 180 in greater detail. FIG. 5 is a rear perspective view of the connector assembly 101, and FIG. 6 is a plan view of the support structure 180 and the power cable 114. The support structure 180 includes cover panels 332, 334 and bridge elements 336, 338 that extend between the cover panels 332, 334. In the illustrated embodiment, the cover panels 332, 334 are configured to cover the openings 205, 207 (FIG. 2) that provide access to the interior cavities 210, 212 (FIG. 2) and to also provide support to prevent the connector housings 124, 126 (FIG. 5) from being inadvertently moved. In other embodiments, the cover panels 332, 334 may only provide support or only cover the openings 205, 207. As shown in FIG. 5, the cover panel 334 and the connector housing 126 may define a gap $G_1$ at the rear face 206 (FIG. 2) of the connector housing 126. (Although not shown, the cover panel 332 and the connector housing 124 may also define a gap.) The gap $G_1$ may be configured to accommodate the size and shape of the power cable 114 to permit the power cable 114 to extend into the interior cavity 212. Also shown in FIGS. 5 and 6, the mounting members 182, 184 (FIG. 6) are coupled to the cover panels 332, 334 and include grip elements 337, 339 (FIG. 6). The grip elements 337, 339 are configured to be inserted into the mounting slots 233, 243 (FIG. 2). The grip elements 337, 339 may facilitate holding the connector housings 124, 126, respectively, in the predetermined position.

In the exemplary embodiment, the support structure 180 includes a support window 340 (FIG. 5). The support window 340 may be defined by the bridge elements 336, 338 and the cover panels 332, 334. For example, the bridge elements 336, 338 may extend along a bridge plane BP (FIG. 6). The support window 340 may coincide with the bridge plane BP and extend across the separation distance SD. The power cable 114 is configured to extend alongside the support structure 180 and through the space of the support window 340. By positioning the power cable 114 to extend through the support window 340, the connector assembly 101 may increase the available space within the component-receiving space 170 (FIG. 1).

However, in alternative embodiments, the support structure 180 may not include the support window 340 and, instead, may have a continuous sheet of material extending across the separation distance SD. In such embodiments, the power cable 114 may be configured to extend alongside the support structure either immediately adjacent to a front side of the support structure or immediately adjacent to a back side. In other embodiments, the power cable 114 does not extend alongside a support structure and instead may extend across the separation distance SD in other manners.

In FIG. 6, the support structure 180 and the power cable 114 may be shaped to have a predetermined contour as the power cable 114 and the bridge elements 336, 338 extend across the separation distance SD. For example, the bridge elements 336, 338 and the power cable 114 may be offset from the cover panels 332, 334 by a distance OD measured in the insertion direction $I_D$. In the illustrated embodiment, the support structure 180 and the power cable 114 are substantially planar as the support structure 180 and the power cable 114 extend across the separation distance SD. However, in other embodiments, the support structure 180 and the power cable 114 may be shaped to have a predetermined contour.

Figure 7:
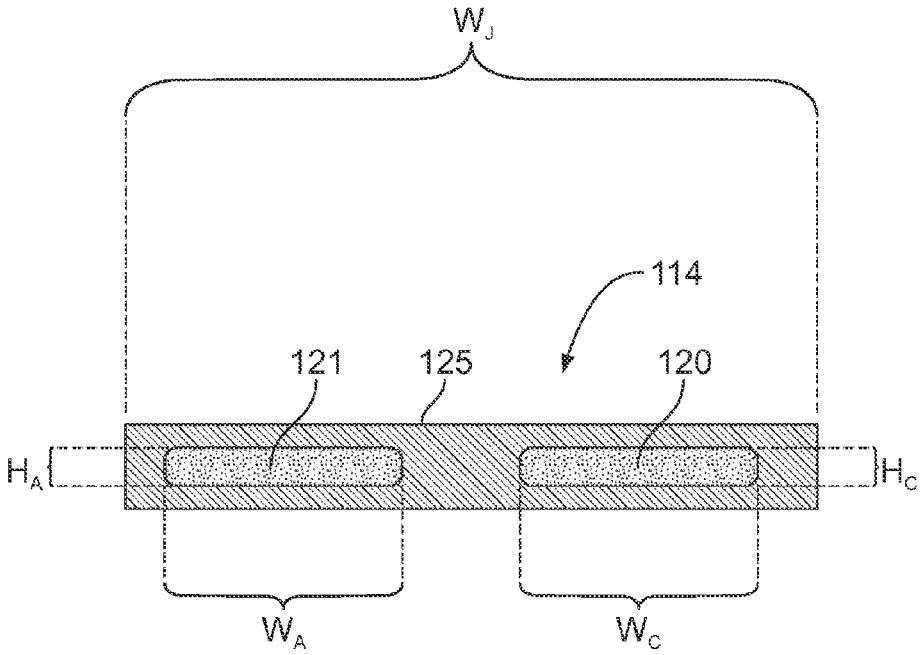
FIG. 7 is a cross-section of the power cable that may be used with the connector assembly of FIG. 1.

FIG. 7 is a cross-section of the power cable 114. As shown, the power cable 114 includes the anode and cathode conductive layers 121, 120 and the insulative jacket 125. The anode and cathode conductive layers 121, 120 may have respective dimensions that include heights $H_A$, $H_C$ and widths $W_A$, $W_C$. The dimensions may be configured so that the anode and cathode conductive layers 121, 120 have predetermined current-carrying capacities. The power cable 114 has a width $W_J$. The power cable 114, the insulative jacket 125, and the anode and cathode conductive layers 121, 120 may be substantially flat. As used herein, the phrase "substantially flat" includes the dimensions (e.g., the widths and heights) having corresponding ratios of at least 2:1. In particular embodiments, the dimension ratio may be at least about 3:1 and, more particularly, at least about 5:1 or at least about 8:1. The power cable 114 may be flexible and capable of being shaped in a predetermined manner. In some embodiments, the power cable 114 may retain its shape.

As shown, the insulative jacket 125 of the power cable 114 surrounds the anode and cathode conductive layers 121, 120. The insulative material of the insulative jacket 125 may also separate the anode and cathode conductive layers 121, 120. However, in other embodiments, the insulative jacket 125 may have two separate jackets that each surround one of the anode and cathode conductive layers 121, 120. Furthermore, in the illustrated embodiment, there are only two conductive layers 121, 120. In other embodiments, there may be more than two conductive layers.

Figure 8:
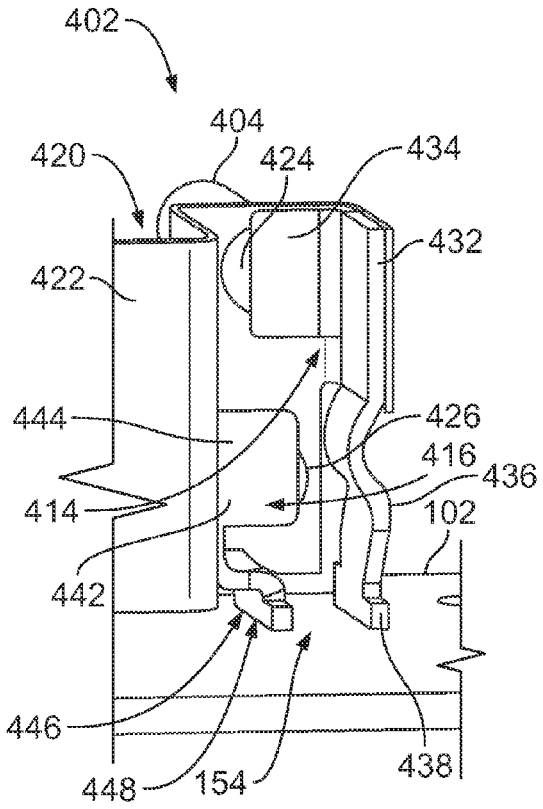
FIG. 8 is a back perspective view of a contact assembly that may be used with the connector assembly of FIG. 1.
Figure 9:
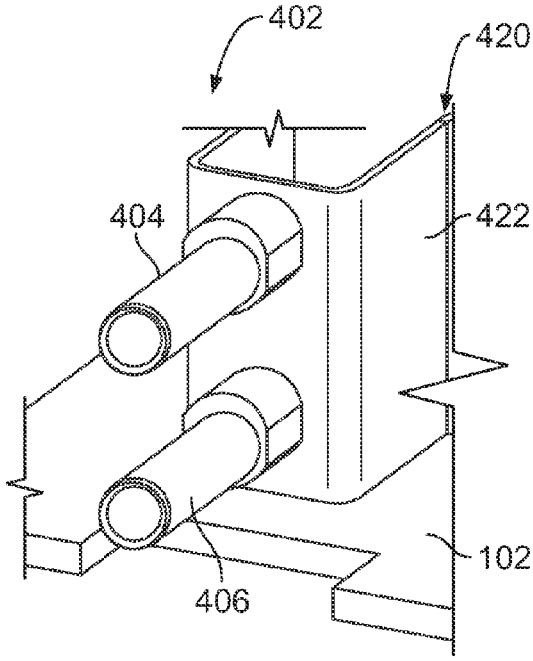
FIG. 9 is a front perspective view of the contact assembly of FIG. 8.
Figure 10:
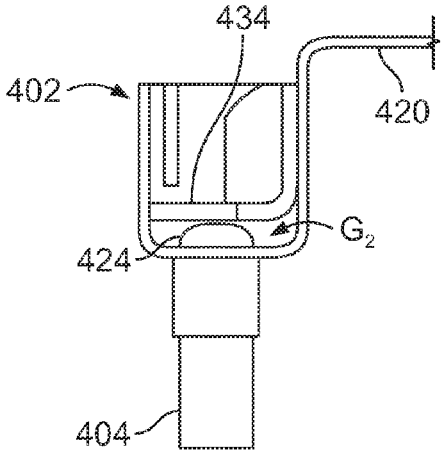
FIG. 10 is a plan view of the contact assembly of FIG. 8.

FIGS. 8-10 illustrate a contact assembly 402 that may be used in the connector assembly 101. Similar to the contact assemblies 214, 216 (FIG. 2), the contact assembly 402 may be electrically coupled to one or more similar constructed contact assemblies. FIGS. 8 and 9 are back and front perspective views, respectively, of the contact assembly 402. The contact assembly 402 includes cathode and anode contacts 404, 406 (FIG. 9) and cathode and anode terminals 414, 416 (FIG. 8) that are configured to be electrically coupled to the cathode and anode contacts 404, 406, respectively. The cathode and anode terminals 414, 416 may be configured to be inserted into the interconnections 154 (FIG. 8) of the circuit board 102. The cathode and anode contacts 404, 406 are mechanically and electrically coupled to a power cable 420. The power cable 420 is similar to the power cable 114 (FIG. 1) and includes cathode and anode conductive layers (not shown) that are surrounded by an insulative jacket 422.

The cathode and anode contacts 404, 406 may be similar to the cathode and anode contacts 252, 254 (FIG. 3) described above. For example, the cathode and anode contacts 404, 406 may be stamped and formed from sheet material and include similar features. In the illustrated embodiment, the cathode and anode contacts 404 and 406 are mechanically and electrically coupled to the respective conductive layers by using fasteners 424, 426 (FIG. 8). The fasteners 424, 426 may penetrate through the conductive material of the conductive layers (not shown) and couple to the cathode and anode contacts 404, 406.

The cathode terminal 414 includes a terminal tab 432, a positive stop 434, a body portion 436, and a circuit-engagement portion 438. The terminal tab 432 is configured to interface with and mechanically and electrically couple to the power cable 420 and, more specifically, to the cathode conductive layer (not shown) of the power cable 420. In the illustrated embodiment, the positive stop 434 extends from the terminal tab 432 and is located proximate to the fastener 424. The circuit-engagement portion 438 is configured to be inserted into a corresponding interconnection 154.

Likewise, the anode terminal 416 includes a terminal tab 442, a positive stop 444, a body portion 446, and a circuit-engagement portion 448. The terminal tab 442 is configured to interface with and mechanically and electrically couple to the power cable 420 and, more specifically, to the anode conductive layer (not shown) of the power cable 420. In the illustrated embodiment, the positive stop 444 extends from the terminal tab 442 and is located proximate to the fastener 426. The circuit-engagement portion 448 is configured to be inserted into a corresponding interconnection 154. In the exemplary embodiment, the terminal tabs 432, 442 are oriented perpendicular to the respective positive stops 434, 444. However, in alternative embodiments, the terminal tabs 432, 442 may be oriented parallel or coplanar to the positive stops 434, 444 and/or in another orientation.

As shown in FIG. 10, the positive stop 434 is separated from the fastener 424 by a gap $G_2$. In some embodiments, the flexible quality of the power cable 420 may permit the cathode contact 404 to move relative to the connector housing (not shown) such that the cathode contact 404 may float with respect to the connector housing. For example, when the cathode contact 404 engages a corresponding power contact (not shown), the cathode contact 404 may be deflected in various directions by the power contact. More specifically, the cathode contact 404 may be deflected toward the positive stop 434. The positive stop 434 may operate to prevent the anode contact 404 from moving any further.

It is to be understood that the above description is intended to be illustrative, and not restrictive. In addition, the above-described embodiments (and/or aspects or features thereof) may be used in combination with each other. Furthermore, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A power connector comprising:

a connector housing having an interior cavity, a mating face, and a mounting interface, the mounting interface configured to be mounted to a printed circuit board;

a contact assembly including anode and cathode contacts that are configured to electrically engage power contacts of a mating connector, the contact assembly also including anode and cathode terminals disposed in the interior cavity, the anode and cathode terminals being electrically coupled to the anode and cathode contacts, respectively, and configured to be electrically coupled to the circuit board; and a power cable having substantially flat anode and cathode conductive layers that are surrounded by an insulative jacket, the anode and cathode conductive layers being electrically coupled to the anode and cathode contacts, respectively, and electrically parallel to the anode and cathode terminals, respectively;

wherein an outer perimeter of the mounting interface defines a mounting area along the circuit board when the connector housing is mounted thereto, the anode and cathode terminals including circuit-engagement portions that mechanically and electrically couple to the circuit board in the mounting area.

2. The power connector of claim 1, wherein the power cable comprises a wave crimp cable.

3. The power connector of claim 1, wherein the contact assembly is a first contact assembly, the connector assembly further comprising a second contact assembly that is remotely located relative to the first contact assembly, the second contact assembly comprising anode and cathode contacts and anode and cathode terminals, the anode conductive layer being electrically coupled to the anode contacts of the first and second contact assemblies and the cathode conductive layer being electrically coupled to the cathode contacts of the first and second contact assemblies, wherein the anode and cathode terminals include circuit-engagement portions that mechanically and electrically couple to the circuit board.

4. The connector assembly of claim 1, wherein the circuit-engagement portions project beyond the mounting interface such that the circuit-engagement portions are configured to be inserted into the circuit board when the connector housing is mounted thereto.

5. The connector assembly of claim 1, wherein the anode contact and the anode terminal include contact and terminal layers, respectively, and the anode conductive layer includes a layer end, wherein the contact layer, the terminal layer, and the layer end are coupled to one another at an electrical joint.

6. The connector assembly of claim 5, further comprising the circuit board.

7. An electrical connector assembly comprising:

first and second power connectors configured to be mounted to a printed circuit board and spaced apart by a separation distance on the circuit board, each of the first and second power connectors comprising a connector housing and a contact assembly held by the connector housing, the contact assembly of the first power connector being electrically coupled to the circuit board at a first interconnection, and the contact assembly of the second power connector being electrically coupled to the circuit board at a second interconnection, the contact assemblies of the first and second power connectors including respective mating contacts that removably engage corresponding power contacts as the corresponding power contacts are moved along a mating axis that extends substantially parallel to the circuit board; and a power cable extending across the separation distance and being affixed to the first and second power connectors, the power cable comprising a substantially flat conductive layer and an insulative jacket that surrounds the conductive layer, wherein the first power connector is electrically coupled to the second interconnection through the conductive layer and wherein the second power connector is electrically coupled to the first interconnection through the conductive layer.

8. The connector assembly of claim 7, wherein the power cable extends along a lateral axis exterior of the connector housing, the anode and cathode contacts being stacked with respect to each other along an elevation axis that is perpendicular to the lateral axis.

9. The connector assembly of claim 7, wherein each of the first and second power connectors is configured to transmit electrical power through the first interconnection and through the second interconnection such that the circuit board may receive electrical power through the first and second interconnections when only one of the first or second power connectors is receiving the electrical power.

10. The connector assembly of claim 7, wherein the connector housing of at least one of the first and second power connectors has a mounting interface that is mounted to the circuit board, wherein an outer perimeter of the mounting interface defines a mounting area along the circuit board when the connector housing is mounted thereto, the contact assembly of the at least one of the first and second power connectors having a circuit-engagement portion that mechanically and electrically couples to the circuit board in the mounting area.

11. The connector assembly of claim 7, wherein the mating contacts of the contact assemblies of the first and second power connectors are first and second mating contacts, respectively, the contact assemblies of the first and second power connectors also including first and second component terminals, respectively, the first mating contact being electrically coupled to the first component terminal and the second mating contact being electrically coupled to the second component terminal.

12. The connector assembly of claim 7, wherein the conductive layer is directly secured to the contact assemblies of the first and second power connectors.

13. An electrical connector assembly comprising:

first and second power connectors configured to be mounted to a printed circuit board and spaced apart by a separation distance an the board, each of the first and second power connectors comprising a connector housing and a contact assembly held by the connector housing, the contact assembly of the first power connector being electrically coupled to the circuit board at a first interconnection, and the contact assembly of the second power connector being electrically coupled to the circuit board at a second interconnection; and a power cable configured to extend across the separation distance and electrically couple the contact assemblies of the first and second power connectors, the power cable comprising a substantially flat conductive layer and an insulative jacket that surrounds the conductive layer, wherein the first power connector is electrically coupled to the second interconnection through the conductive layer and wherein the second power connector is electrically coupled to the first interconnection through the conductive layer;

wherein the contact assemblies comprise mating contacts configured to engage power contacts of a mating connector and component terminals configured to be electrically coupled to the circuit board, the mating contact and the component terminal of the contact assembly of the first power connector being electrically coupled to each other, the mating contact and the component terminal of the contact assembly of the second power connector being electrically coupled to each other.

14. The connector assembly of claim 13, wherein the conductive layer is directly coupled to the contact assemblies of the first and second power connectors.

15. The connector assembly of claim 13, wherein the power cable comprises a wave crimp cable.

16. The connector assembly of claim 13, wherein the connector housings of the first and second power connectors have respective footprints that define respective mounting areas when mounted to the circuit board, the first interconnection occurring within the mounting area of the first power connector and the second interconnection occurring within the mounting area of the second power connector.

17. An electrical connector assembly comprising:

first and second power connectors configured to be mounted to a printed circuit board and spaced apart by a separation distance on the circuit board, each of the first and second power connectors comprising a connector housing and a contact assembly held by the connector housing, the contact assembly of the first power connector being electrically coupled to the circuit board at a first interconnection, and the contact assembly of the second power connector being electrically coupled to the circuit board at a second interconnection;

power cable configured to extend across the separation distance and electrically couple the contact assemblies of the first and second power connectors, the power cable comprising a substantially flat conductive layer and an insulative jacket that surrounds the conductive layer, wherein the first power connector is electrically coupled to the second interconnection through the conductive layer and wherein the second power connector is electrically coupled to the first interconnection through the conductive layer; and a rigid support structure that extends across the separation distance and couples to the first and second power connectors, the power cable extending alongside the support structure.

18. The connector assembly of claim 17, wherein the support structure is conductive and provides electromagnetic interference (EMI) shielding for the power cable.

19. The connector assembly of claim 17, wherein the support structure is thermally conductive and defines a heat sink for dissipating heat from the power cable.

20. The connector assembly of claim 17, wherein the first and second power connectors define a component-receiving space therebetween that is configured to receive a component, the power cable and the support structure being positioned such that a height of the component is not restricted by the power cable or the support structure, the height of the component being measured along an elevation axis that is perpendicular to the circuit board.

* * * * *